US007214121B1

(12) United States Patent
Huang

(10) Patent No.: US 7,214,121 B1
(45) Date of Patent: May 8, 2007

(54) RESILIENT BRA CUP STRUCTURE

(76) Inventor: Huei-Rong Huang, No. 29, Lane 187, Cyong Lin S. Road, SinJhuang, Taipei County (TW)

( * ) Notice: Subject to any disclaimer, the term of this patent is extended or adjusted under 35 U.S.C. 154(b) by 0 days.

(21) Appl. No.: 11/446,298

(22) Filed: Jun. 5, 2006

(51) Int. Cl.

| | |
|---|---|
| ***A41C 3/10*** | (2006.01) |
| ***A41C 3/14*** | (2006.01) |
| ***A41C 5/00*** | (2006.01) |
| *A41C 3/12* | (2006.01) |

(52) U.S. Cl. ..... 450/39; 450/38; 450/57; 450/92; 450/93

(58) Field of Classification Search ..... 450/39, 450/1, 92, 93, 94, 38, 54–57; 2/243.1, 78.1–78.4, 2/73; 156/245; 264/152–155, 157, 163, 264/257, 160, 258, 291, 292, 294, 320, 321
See application file for complete search history.

(56) References Cited

U.S. PATENT DOCUMENTS

| | | | | |
|---|---|---|---|---|
| 5,447,462 | A * | 9/1995 | Smith et al. | 450/122 |
| 5,916,829 | A * | 6/1999 | Girard et al. | 442/244 |
| 6,837,771 | B2 * | 1/2005 | Falla | 450/39 |

* cited by examiner

*Primary Examiner*—Gloria M. Hale
(74) *Attorney, Agent, or Firm*—Rabin & Berdo, P.C.

(57) ABSTRACT

The present invention is to provide an improved resilient bra cup structure with adjustable stiffness or softness, wherein the bra cup structure having at least four layers comprising a layer of stiff knitted fabric, a layer of meshed gel, a layer of resilient staple fiber, and a layer of soft knitted fabric. The layer of meshed gel is subjected to a heating process for thermally bonded between the layer of stiff knitted fabric and the layer of resilient staple fiber. Furthermore, the thermally-bonded sandwiched fabric is bonded to the layer of soft knitted fabric for forming a compound fabric to make a bra cup.

4 Claims, 6 Drawing Sheets

RESILIENT BRA CUP STRUCTURE

FIELD OF THE INVENTION

The invention is related to an improved bra cup, and more particularly, to an improved resilient bra cup structure with complex function of comfort, flexibility, support and visual effect.

BACKGROUND OF THE INVENTION

Modern brassieres (hereinafter referred to as "bra cups") designed to accommodate the needs for comfort during wear, as well as the needs for support. Thus, these bra cups attempted to provide flexibility, freedom of movement, stretchability, and breast support in marketing. To provide these features, bra cups have been made out of flexible staple fiber or nonwoven fabric. These bra cups did not have enough stiffness to meet visual demand. The assembly of these bra cups was manufactured into final one-piece products, and often made of uniform material. However, bra cups with uniform materials did not meet purchasers' needs. Although they could comply with the needs for flexibility, manufactures for producing these bra cups often omitted the needs for visual appeal. The visual demand is also an important consideration in the production of a bra cup, and is the most important aspect in the purchasing decision made by a potential purchaser. Based on the market view this is the biggest difference on products. Besides, if the bra cups are made of only stiff material, the flexibility and comfort are not sufficient to users. While early bra cups have become more delicate, they may not have provided the complex function of comfort, flexibility, bra cup support and visual demand that are desired for the purchaser's needs.

Therefore, a need exists for an improved bra cup structure capable of providing complex function of comfort, flexibility, support and visual appeal. The invention will provide an improved bra cup which doesn't deform when pulled and dragged, and which has maximum comfort, flexibility, bra cup support, and visual appeal.

SUMMARY OF THE INVENTION

Accordingly, the main object of the invention is to provide an improved bra cup structure, wherein the bra cup structure comprises at least four layers: a layer of stiff knitted fabric, a layer of a gel material below the layer of stiff knitted fabric, a layer of resilient staple fiber below the layer of gel material, and a layer of soft knitted fabric below the layer of resilient staple fiber. The layer of stiff knitted fabric is made up of knitted fabric whose property is stiff and resilient. The layer of soft knitted fabric is made up of knitted fabric whose property is soft and resilient. The layer of gel material is subjected to a heating process for being thermally bonded between the layer of stiff knitted fabric and the layer of resilient staple fiber. Thus, the layer of stiff knitted fabric, the layer of gel material and the layer of resilient staple fiber together form a thermally-bonded sandwiched fabric. Then, the thermally-bonded sandwiched fabric is bonded to the layer of soft knitted fabric for forming a compound fabric to make a bra cup.

Furthermore, in accordance with the invention, the sandwiched fabric including a layer of stiff knitted fabric, a layer of a gel material, and a layer of resilient staple fiber is to render a stiffer outer layer, not only for the visual enhancement of the user's breasts but also for the support and lift function. Additionally, there are other advantages also disclosed because of the bra cup structure, such as better resilience and endurable ability, uneasily oxidized ability, and capability of resisting changing in shape.

To achieve the foregoing objects, there is provided an improved bra cup structure with different degree of stiffness or softness, wherein the bra cup structure comprises at least four layers: a layer of stiff knitted fabric, a layer of a gel material, a layer of resilient staple fiber, and a layer of soft knitted fabric.

The layer of stiff knitted fabric is made up of resilient stiff knitted fabric, and the layer of resilient staple fiber is made up of non-spin fiber. The layer of gel material is pre-positioned between the layer of stiff knitted fabric and the layer of resilient staple fiber, and is subjected to a heating process for thermally bonded between the layer of stiff knitted fabric and the layer of resilient staple fiber. Thus, the thermally-bonded sandwiched fabric renders a stiffer outer layer, not only for the better visual enhancement of the user's breasts when any design is applied to mold the bra cup appearance, but also for the support and lift function. The soft knitted fabric is provided to contact wearers' breasts because of its better resiliency. Apart from its better resiliency, the soft knitted fabric may also strengthen the bra cup structure, increase stretchability, and improve air-permeability. Furthermore, the knitted fabric may provide more advantages such as better resilience and endurable ability, uneasily oxidized ability, and capability of resisting changing in shape.

BRIEF DESCRIPTION OF THE DRAWINGS

The foregoing aspects, as well as many of the attendant advantages and features of this invention will become more apparent by reference to the following detailed description, when taken in conjunction with the accompanying drawings, wherein.

DESCRIPTION OF THE PREFERRED EMBODIMENT

The foregoing and other objects, features and advantages of the present invention will be more readily understood upon consideration of the following detailed first and second preferred embodiment's description of the invention, taken in conjunction with the following drawing.

Figure 1:
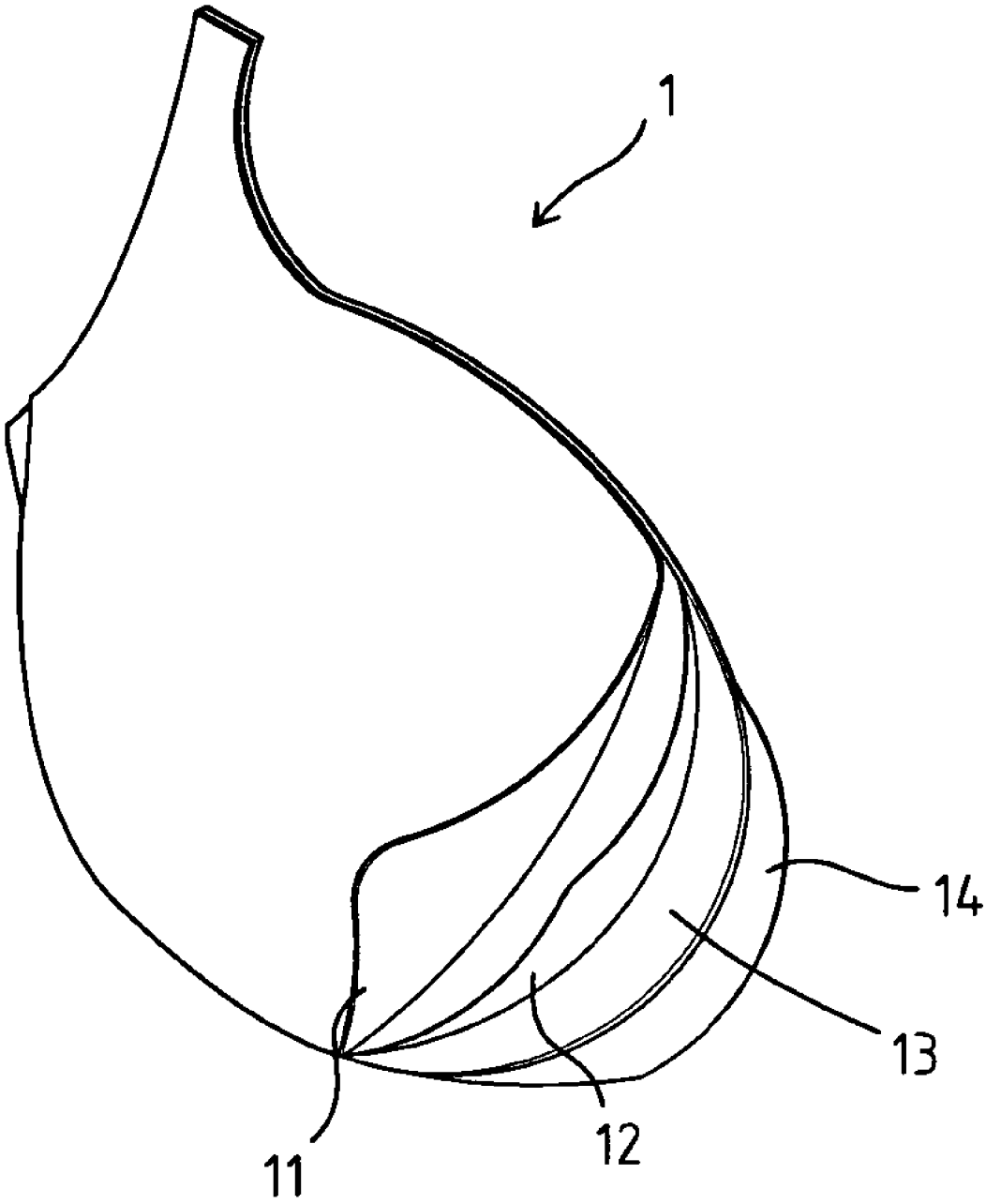
FIG. 1 is a perspective view of the embodiment according to the invention.

With reference to FIG. 1, it is a perspective view of the embodiment according to the invention. There is provided an improved bra cup structure comprising at least four layers: a layer of stiff knitted fabric 11, a layer of a gel material 12 below the layer of stiff knitted fabric 11, a layer of resilient staple fiber 13 below the layer of gel material 12, and a layer of soft knitted fabric 14 below the layer of resilient staple fiber 13. The layer of stiff knitted fabric 11 is made up of knitted fabric whose property is stiff and resilient. The gel material forming the layer 12, preferably, is in a mesh form. The layer of resilient staple fiber 13 is made up of non-spin fiber. The layer of soft knitted fabric 14 is made up of knitted fabric whose property is soft and resilient. The layer of gel material 12 is subjected to a heating process for being thermally bonded between the layer of stiff knitted fabric 11 and the layer of resilient staple fiber 13. Thus, the layer of stiff knitted fabric 11, the layer of gel material 12 and the layer of resilient staple fiber 13 together form a thermally-bonded sandwiched fabric. Then, the thermally-bonded sandwiched fabric (11, 12, 13) is bonded to the layer of soft knitted fabric 14 for forming a compound fabric to make a bra cup.

Figure 2:
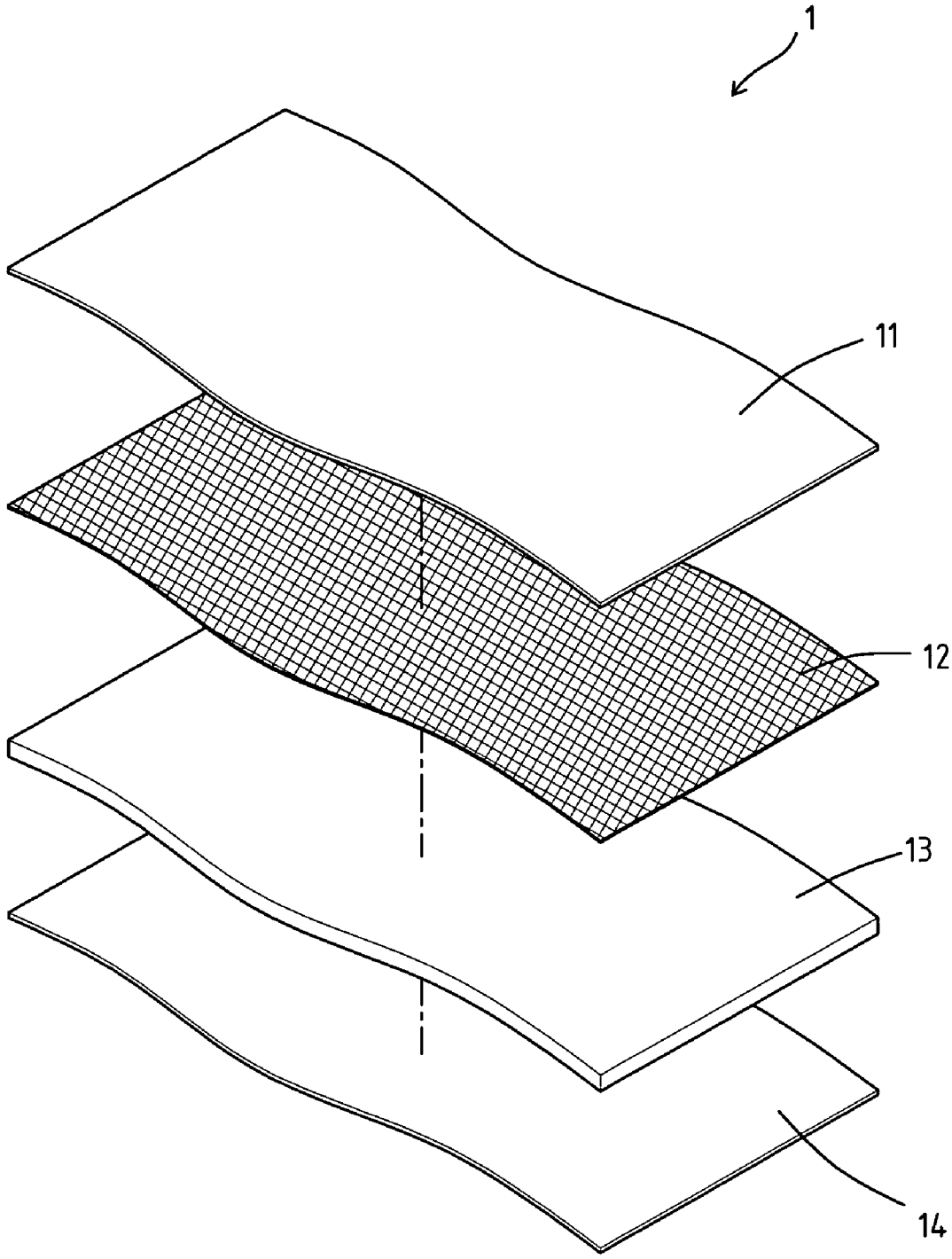
FIG. 2 is a layered view of the embodiment according to the invention.
Figure 3:
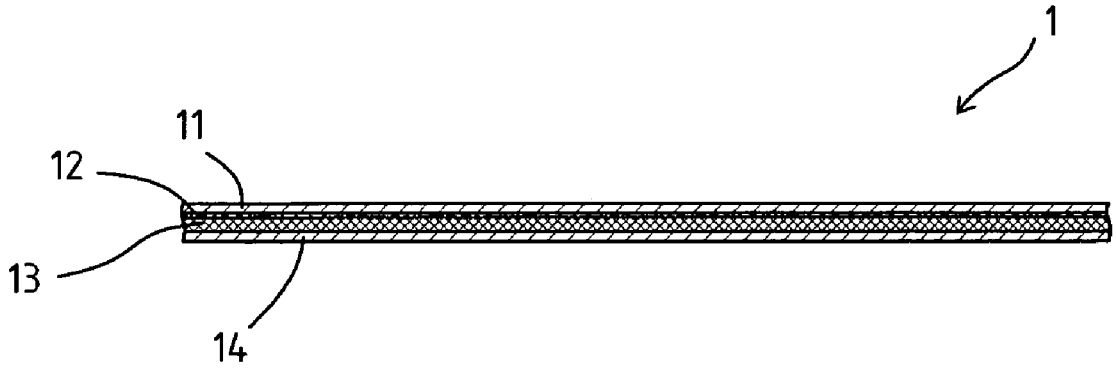
FIG. 3 is a cross-sectional view of the embodiment according to the invention.

With reference to FIG. 2 and FIG. 3, they are respectively a layered view of the embodiment according to the invention and a cross-sectional view of the embodiment according to the invention. The layer of stiff knitted fabric 11 is made up of stiff resilient knitted fabric, and the layer of resilient staple fiber 13 is made up of non-spin fiber.

The layer of gel material 12 is pre-positioned between the layer of stiff knitted fabric 11 and the layer of resilient staple fiber 13, and is subjected to a heating process for thermally bonded between the layer of stiff knitted fabric 11 and the layer of resilient staple fiber 13. Thus, the thermally-bonded sandwiched fabric (11, 12, 13) renders a stiffer outer layer, not only for the better visual enhancement of the user's breasts when any design is applied to mold the bra cup appearance, but also for the support and lift function. The layer of soft knitted fabric 14 is attached to the layer of resilient staple fiber 13 by a conventional method of stitching or cohering. The layer of soft knitted fabric 14 may also strengthen the bra cup structure, increase stretchability, and improve air-permeability. Furthermore, the knitted fabric (11, 14) may provide more advantages such as better resilience and endurable ability, uneasily oxidized ability, and capability of resisting changing in shape.

Figure 4:
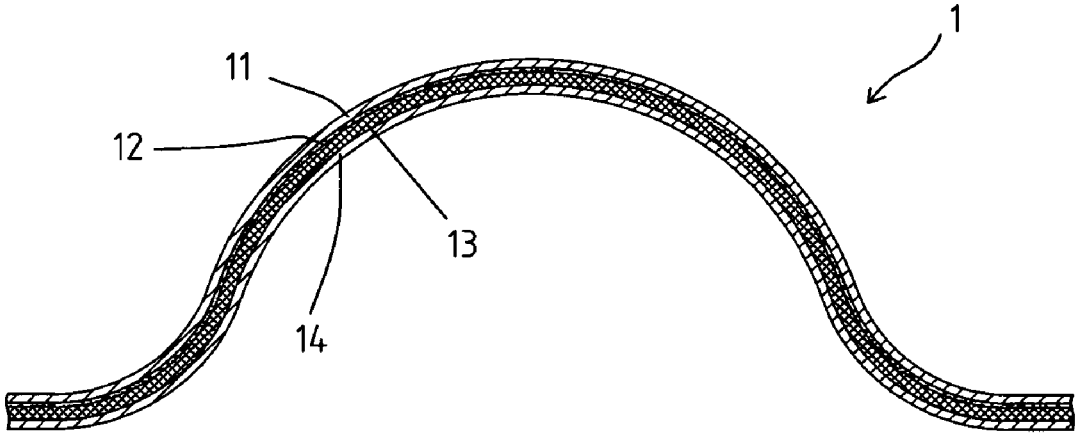
FIG. 4 is a cross-sectional view of the molded embodiment according to the invention.
Figure 5:
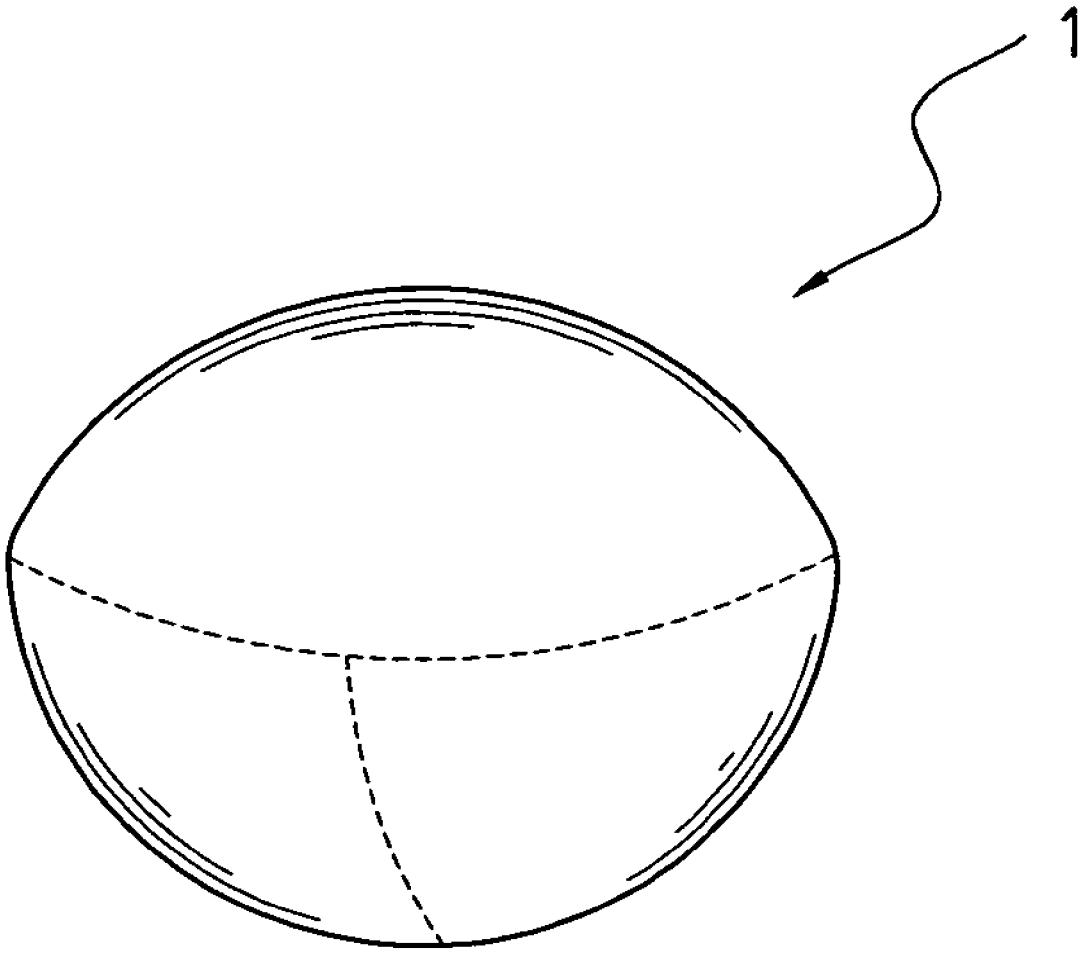
FIG. 5 is a vertical view of the tailored and sewn embodiment according to the invention.

By means of compression and consolidation, the layer of stiff knitted fabric, the layer of gel material, the layer of resilient staple fiber, and the layer of soft knitted fabric are molded together to form a compound fabric. With reference to FIG. 4, it is a cross-sectional view of the molded embodiment according to the invention. The compound fabric is molded and a bra cup structure is appeared on the fabric. Eventually, the bra cup structure is tailored from the compound fabric. Furthermore, referred to FIG. 5, it is a vertical view of the tailored and sewn embodiment according to the invention. The compound fabric is tailored into a plurality of required pieces, and the required pieces are sewn together to form the bra cup 1.

Figure 6:
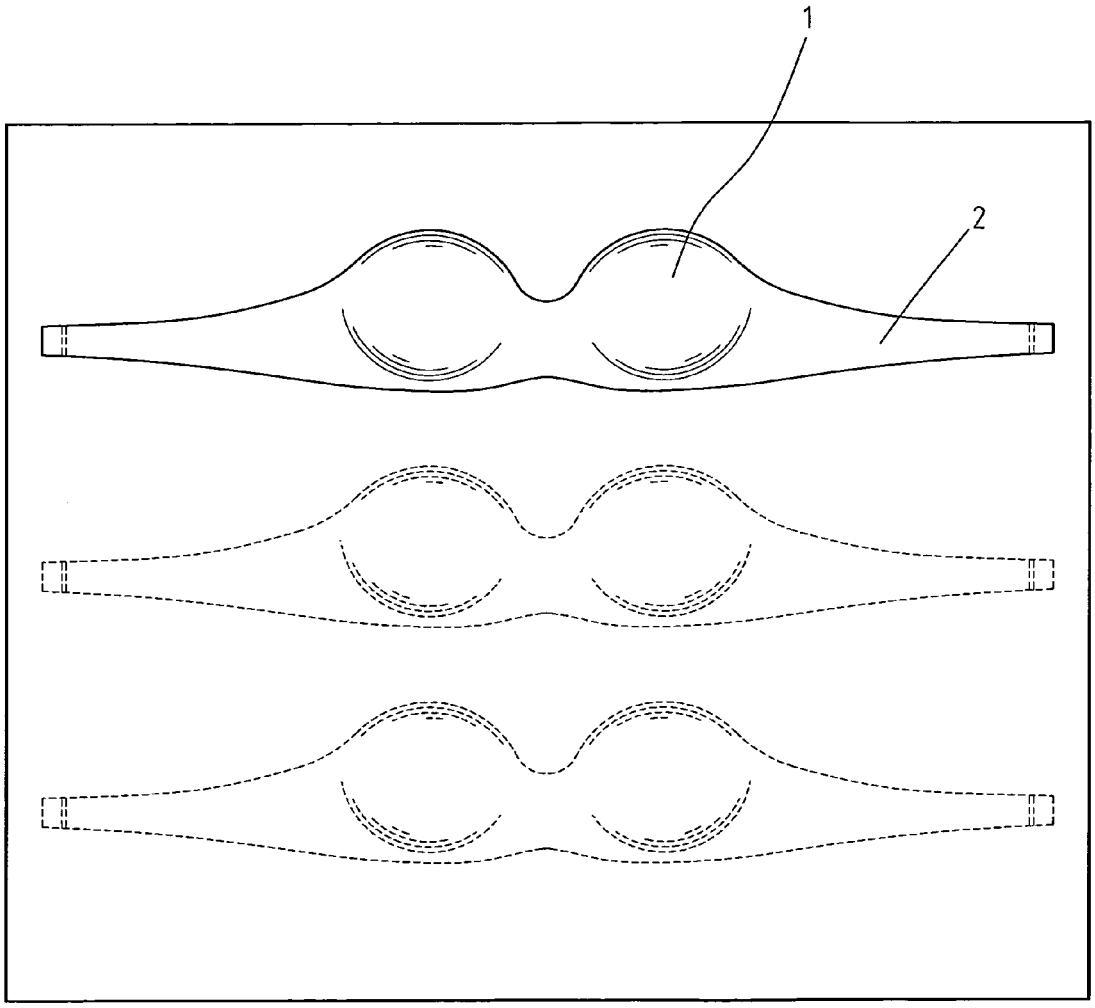
FIG. 6 is a vertical view of the embodiment of the integral bra according to the invention.

Moreover, with reference to FIG. 6, the above-mentioned embodiments emphasis on the bra cup, and the embodiment is focused on an integral bra. The compound fabric is molded to form an integral bra structure. The integral bra consists of the bra cup 1 and the back belt 2. Finally, the integral bra is tailored from the compound fabric. The three embodiments above embody the three-dimensional bra cup structure with required functions to accommodate and support wearers' breasts.

Because of the materials and the ways of manufacturing, the present invention not only provides the comfortable touch to the users while wearing but also provides the users' breasts with the support and lift function. The dual advantage satisfies the requirements of the users for the sense of touch as well as the visual enhancement.

While the present invention has been described in connection with a preferred embodiment thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. An improved resilient bra cup structure comprising:

a layer of stiff knitted fabric;

a layer of a gel material, below the layer of stiff knitted fabric;

a layer of resilient staple fiber, below the layer of gel material; and a layer of soft knitted fabric, below the layer of resilient staple fiber;

the layer of stiff knitted fabric, the layer of gel material and the layer of resilient staple fiber together forming a sandwiched fabric in which the layer of gel material is thermally bonded between the layer of stiff knitted fabric and the layer of resilient staple fiber, the sandwiched fabric being bonded to the layer of soft knitted fabric so as to form a compound fabric bra cup.

2. The improved resilient bra cup structure of claim 1, wherein the compound fabric is molded to form a bra cup.

3. The improved resilient bra cup structure of claim 1, wherein the compound fabric is tailored into a plurality of pieces, and the pieces are sewn together to form a bra cup.

4. The improved resilient bra cup structure of claim 1, wherein the compound fabric is molded to form an integral bra structure comprising a bra cup and a back belt.

* * * * *